US005457932A

United States Patent [19]

Spada et al.

[11] Patent Number: 5,457,932

[45] Date of Patent: Oct. 17, 1995

[54] DEVICE WITH A PACKAGING WHEEL, FOR SUPPLYING SHEETS, IN PARTICULAR IN CIGARETTE PACKAGING MACHINES

[75] Inventors: Valter Spada, Marzabotto; Giuseppe Tosi, Modena, both of Italy

[73] Assignee: SASIB S.p.A., Italy

[21] Appl. No.: 301,385

[22] Filed: Sep. 7, 1994

[30] Foreign Application Priority Data

Sep. 15, 1993 [IT] Italy ..... GE93A0081

[51] Int. Cl.[6] ..... B65B 49/00

[52] U.S. Cl. ..... 53/234; 53/389.1

[58] Field of Search ..... 53/389.1, 389.3, 53/389.5, 225, 228, 233, 234

[56] References Cited

U.S. PATENT DOCUMENTS

| | | | |
|---|---|---|---|
| 2,933,871 | 2/1958 | Brook | 53/234 |
| 2,954,655 | 11/1958 | Seragnoli | 53/234 |
| 3,899,865 | 8/1975 | Revaz | 53/234 |
| 4,095,396 | 6/1978 | Seragnoli | 53/234 |
| 4,918,901 | 4/1990 | Gamberini et al. | 53/389.1 |

*Primary Examiner*—John Sipos
*Assistant Examiner*—Ed Tolan
*Attorney, Agent, or Firm*—Larson and Taylor

[57] ABSTRACT

A device with a packaging wheel, for supplying sheets, in particular in cigarette packaging machines, comprises means (20, 20') for collecting/positioning the packaging sheets (F) in a predetermined position, in a transfer station (T), between a cell (101) of a transfer drum (1) which accomodates a group of cigarettes (S) and an empty cigarette-carrying cell (102) of a folding drum (2) opposite. During transfer into the cell (102) of the folding drum (2), the group of cigarettes (S) draws the sheet (F) which is folded automatically in a U-shape around the cigarettes (S) by the cigarette-carrying cell (102). According to the invention, the collecting/positioning means (20, 20') consist of mechanical gripper means for grasping the packaging sheet (F) which are provided at least on the front side of each cigarette-carrying cell (101) of the transfer drum (1), with reference to the direction of rotation of the drum.

9 Claims, 9 Drawing Sheets

DEVICE WITH A PACKAGING WHEEL, FOR SUPPLYING SHEETS, IN PARTICULAR IN CIGARETTE PACKAGING MACHINES

The invention relates to a device with a packaging wheel, for supplying sheets, in particular in cigarette packaging machines, which device comprises a drum for folding packaging sheets, for example made of foil, around individual groups of cigarettes, which is provided on its periphery with a plurality of cigarette-carrying cells, and a drum for transferring groups of cigarettes from a supply line to the folding drum which is also provided with at least one cigarette-carrying cell, which is conveyed to a transfer station, into a position such that it is frontally aligned with an empty cigarette-carrying cell of the folding drum, whereas the group of cigarettes is moved by drive means from the cell of the transfer drum into the cell of the folding drum, each cell of the transfer drum being associated with collecting/positioning means each for one sheet, which can be moved angularly together with the associated cell, and which take a sheet into a predetermined position corresponding to the group of cigarettes to be transferred between the associated cell of the transfer drum and the cell of the folding drum in the transfer station, such that, when the group of cigarettes is transferred into the cell of the folding drum, the sheet is thrust by the cigarettes into the said cell, and is folded in a U-shape around the cigarettes.

Packaging sheet supply devices of this type are known. In these devices, the sheet collecting/positioning means associated with the cells consist of aspirating surfaces in the form of circular sectors concentric relative to the drum, and which are provided laterally adjacent to the mouth of the cells, on the front and rear sides of the latter, with reference to the direction of rotation of the drum. The aspirating surfaces are mounted such as to rotate around the axis of the drum rigidly together with the cells, and cannot carry out any relative movement in relation to the latter. A first disadvantage of these known devices consists in that the sheets are seized and retained by means of aspiration. Obtaining suction pressure such as to allow sufficiently secure adhesion of the sheet to the aspirating surfaces, requires some expensive engineering. However even in this case, the suction pressure which can be achieved is always relatively low, and does not guarantee that the sheet is held perfectly in position. In addition, the aspirating surfaces do not even permit regulation of the position of the sheet, relative to the associated cell. The surfaces also require their own support frame, thus contributing towards increasing the inertia of the drum, which is undesirable in reciprocating motion machines where high operative speeds are required.

The object of the invention is thus to produce a device of the type initially described, in which by relatively simple and inexpensive means, it is possible to seize the packaging sheet and hold it securely in position, simultaneously enabling its position to be regulated relative to the associated cell, all without increasing undesirably the inertial mass of the drum.

The above-described objects are accomplished according to the invention by means of a device of the type initially described, in which the means for collecting/positioning the packaging sheet consist of mechanical gripper means for grasping the packaging sheet, which are provided at least on the front side of each cigarette-carrying cell, with reference to the direction of rotation of the transfer drum.

In addition, each gripper means is mounted on the transfer drum such that it can be moved angularly for a specific limited arc relative to the cell itself, in order to regulate the position of the packaging sheet.

According to an advantageous embodiment, the gripper means are mounted directly on means for closing the mouth of the cells, which are supported on the drum such that they can be moved alternately between an open position and a closed position of the mouth. These closing means can consist for example of two pairs of support arms, which are associated with the front side and the rear side of each cigarette-carrying cell respectively, each of which supports on its end a transverse tab for closing part of the mouth of the cell, and is mounted such as to oscillate around axes parallel to the axis of rotation of the drum, between a position of reciprocal approach, in which they close the mouth, and a position of reciprocal withdrawal or spreading apart, in which the cell is open, forming between themselves a passage for the transfer of the group of cigarettes. In this case the grasping means, for example a gripper, are attached to or are integral with the pair of arms associated with the front side of the cell, with reference to the direction of rotation of the drum.

The specific embodiment of the collecting/positioning means, and their mounting which can be moved relative to the cells according to the invention enables the packaging sheet to be grasped and retained securely, thus to a large extent avoiding positioning errors which can lead to scrapping of the packaging, as well as permitting correction of any minor variations of the position of the sheet relative to the predetermined position in relation to the associated cell in the transfer station T, thus further limiting processing errors and the quantity of potential scrapping.

The use of grippers which are mounted directly on the closing arms of the mouth of the cells, which are generally provided in transfer drums of this type, Permits elimination both of an additional support structure for the collecting/positioning means, and separate drive means for the latter. This allows firstly simplification of the design, and secondly limitation of the masses to be rotated reciprocally at high speed.

The object of the invention is also other features, which further improve the above-described supplying device, and which are the subject of the sub-claims.

The specific features of the invention and its resulting advantages will become apparent from the detailed description of a preferred embodiment, illustrated by way of non-limiting example in the attached drawings, in which.

Figure 1A:
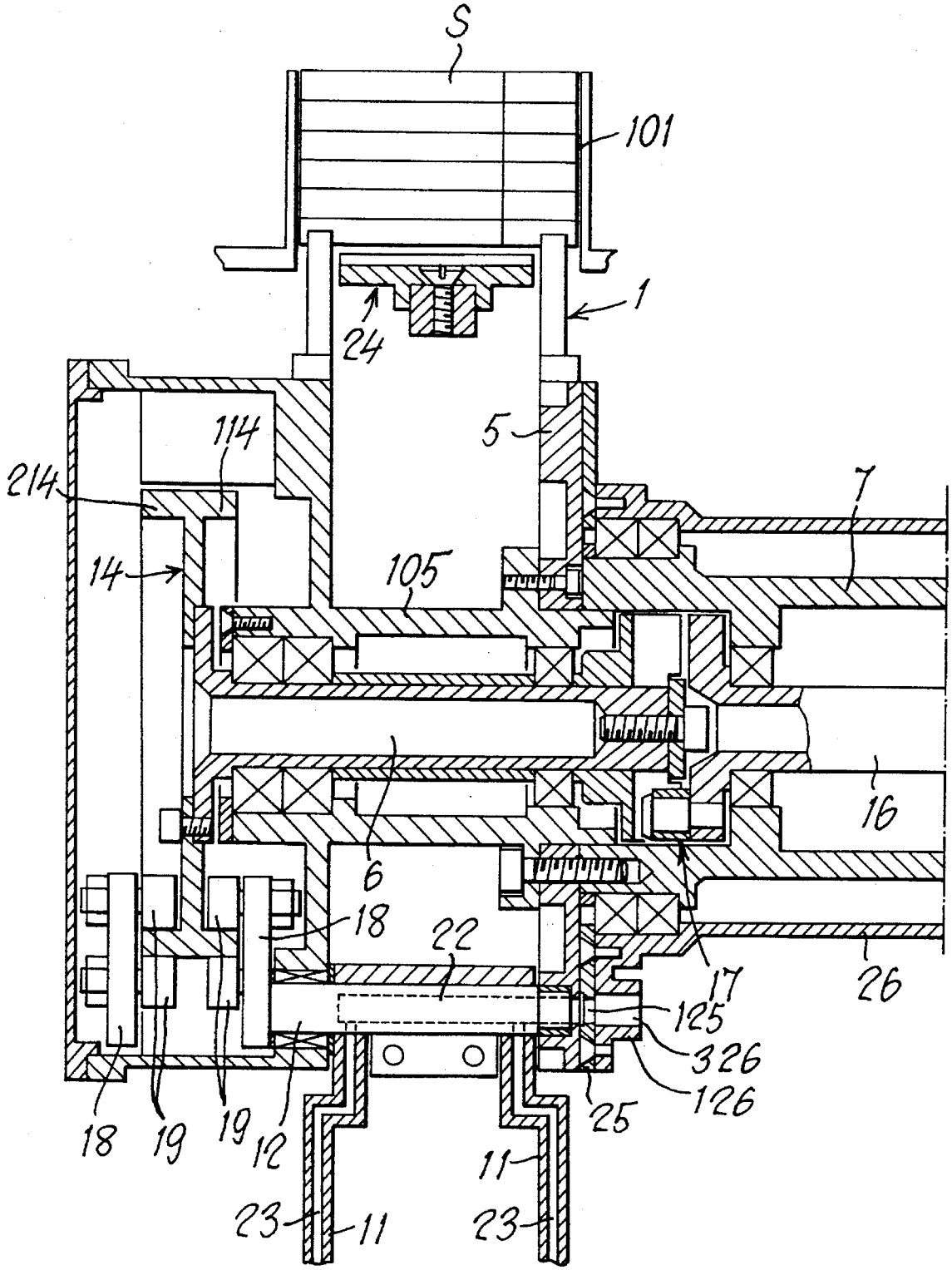
FIGS. 1A and 1B are an axial cross-section of a transfer drum provided with the packaging sheet supplying device according to the invention, for the part relating to the transfer drum and the part relating to the drive means respectively.

With reference to the figures, a cigarette packaging machine has two drums, 1 and 2 (FIGS. 6, 7) supported on the end of spinoles so to rotate around their axes on the front of the machine. The two drums 1, 2 are disposed adjacent to one another and are provided on their periphery with a plurality of cigarette-carrying cells 101, 102. The cells 101, 102 are distributed angularly equidistant from one another, and are open in the position of the surface of the shell of the drums 1, 2. The first, so-called transfer drum 1 is interposed between the second, folding drum 2 and a station A (FIGS. 3, 4, 5) for supplying groups of cigarettes S to the diametrically opposite side. The cigarette-carrying cells 101, 102 of the two drums are oriented with their axis transverse to the cigarettes in the radial direction of the drums 1, 2. The groups of cigarettes S are supplied to the transfer station A by a cradle-type conveyor belt 3. Each of the cradles 103 is brought into the position which, in the direction of the axis of the drum, coincides with an empty cell 101 thereof, and the group of cigarettes is inserted in the cigarette-carrying cell 101 of the transfer drum 1 by means of axial, simultaneous movement of all the cigarettes S of the group. On the side diametrically opposite to the supply station A, between the transfer drum 1 and the adjacent so-called folding drum 2, there is a station T for transferring the group of cigarettes S from the transfer drum 1 to the folding drum 2. In this station T, a full cigarette-carrying cell 101 of the transfer drum 1 is brought into a position of alignment with an empty cell 102 of the folding drum 2, with the respective mouths coinciding with one another. In addition, simultaneously between the two cells 101 and 102, in front of the mouth of the cigarette-carrying cell 101 of the transfer drum 1, before the group of cigarettes S is transferred, a packaging sheet, for example a sheet of metal foil F, is put into position. The sheet F is cut by a belt N and is supplied to collecting/positioning means which are associated with the transfer drum 1, by means of a supply unit 4, and is thus brought to the transfer station T simultaneously with a group of cigarettes (FIGS. 3, 4, 6, 7, 9). When the cigarettes S are transferred, the sheet F is drawn by the group of cigarettes themselves into the cell 102 of the folding drum 2, in which it is simultaneously folded into a U-shape. The two drums 1 and 2 are advantageously driven in rotational steps which are synchronized with one another. In particular, at each rotational step, the transfer drum 1 supplies a full cell 101 to the transfer station T, and an empty cell 101' to the supply station A, whereas the folding drum 2 brings another, successive empty cell 102 to the transfer station T (see also FIGS. 6 and 7).

Figure 1B:
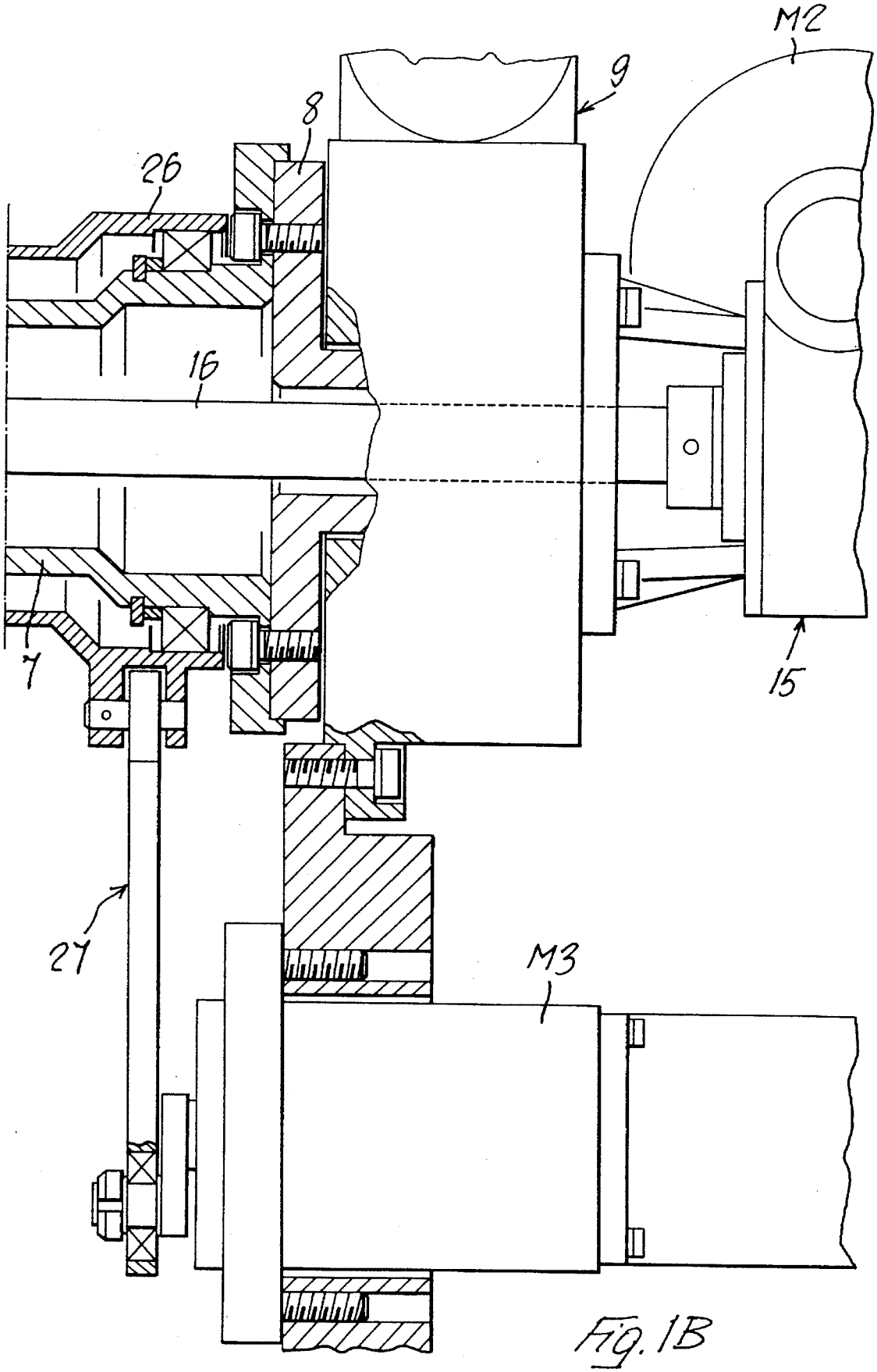

With reference to FIGS. 1A and 1B, a transfer drum 1 has a cell-carrying frame 5 with a central, tubular hub 105 which is mounted such as to rotate on a coaxial shaft 6. The tubular hub 105 is connected such as to rotate with a tubular shaft 7, which is connected such as to rotate with a drive disc 8, which is supported such as to rotate in the frame of the machine, and is rotated by means of an independent rotational step drive unit 9. With each cell 101 of the transfer drum 1, there are associated two pairs of arms, 11, 11'. Each pair of arms 11, 11' is disposed on one of the axial, radial sides of the cigarette-carrying 101, and is supported such as to oscillate around an axis parallel to the axis of rotation of the transfer drum 1. In particular, each pair of arms 11, 11' is supported such that it projects from a small shaft 12 which is parallel to the axis of rotation, and is supported such as to oscillate around its axis in an associated seat of the cell-carrying frame 5. The arms 11, 11' extend in a substantially radial direction as far as the radially outer edge of the cells 101, in the position of the mouth of the latter, and can oscillate towards and away from one another. 0n their free ends, the pairs of arms 11, 11' support tabs 13 which close the mouth of the cigarette-carrying cells 101 transversely, and at least for a partial section of the length of the mouth itself, preferably in the area of the ends of the cigarettes S. The closing tabs 13 are oriented transversely to the arms 11, 11', i.e. in the direction of oscillation towards the associated cell 101, and in the position of closest approach of the two pairs of arms 11, 11', they overlap the corresponding halfway point of the mouth of the cell 101, thus preventing the cigarettes S from emerging radially during the rotational steps of the drum 1, and in the position in which the cell 101 is facing vertically downwards.

Oscillation of the arms, 11, 11' is controlled by means of two concentric and integrally rotating cams 114, 214, which are provided in a chamber on the front side of the transfer drum 1, and rotated by an independent drive unit 15 which is provided with a motor M2, by means of a shaft 16 which is supported such as to rotate coaxially inside the tubular drive shaft 7 of the transfer drum 1. The drive shaft 16 of the cams 114, 214 can be connected such as to rotate by means of releasable connection means 17, with a central drive shaft 6 inside the tubular hub 105 of the cell-carrying frame 5. The small support shafts 12 of the arms 11, 11' engage simultaneously with one of the two cams 114, 214 by means of radial activating levers 18 which are attached at one end to the small shafts 12, whereas on the other end they support two rollers 19 which can engage between them the track of the cams 114, 214, which are in the form of so-called positive-drive cams.

According to an advantageous improvement, the two cams 114, 214 consist of the annular peripheral edges of the opposite surfaces of a disc 14 with a transverse cross-section in the shape of a double "T", and thus for each cell 101, the control levers 18 of the two opposite pairs of arms 11, 11' each engage with one of the opposite peripheral edges of the said disc 14. This takes place identically for the pair of arms 11, 11' of each cell 101. Thus the front pairs of arms 11, relative to the direction of rotation, always engage with the cam 114 on the side which is facing the frame of the machine, whereas the pairs of opposite arms, 11' always engage with the cam 214 on the front side of the disc 14.

The means for collecting/positioning of the sheets F consist of a gripper 20 which is supported by each front pair of arms 11 with reference to the direction of rotation of the drum. The Gripper 20 has two clamping jaws 120, 220, one of which, or at least a part thereof can move against the other. The gripper 20 can be attached to the corresponding pair of arms 11, or can be made integral therewith. The gripper can extend for the entire axial length of the sheet F, or U-shaped jaws can be provided, which grasp the sheet F only at front end, with reference to the direction of supply of the latter, and in the position of the lateral edges.

In addition, the grippers 20 are open on the rear side with reference to the direction of rotation, and have a radial stop wall for the front edge of the sheet F on the opposite side. The jaws 120, 220 are such that the clamping mouth 21 between them is oriented parallel to the direction of detachment of the sheet F from the supply roller 104 of the supply unit 4, which is substantially tangent thereto.

According to an advantageous feature, the mobile jaw 220 or the mobile part thereof is loaded by an elastic element in the direction of opening of the gripper, whereas it can be moved against the stationary jaw 120 by any drive means, for example mechanical, electrical, magnetic, pneumatic or the like.

In the example given, the mobile jaw 220 is driven by means of compressed air, and the supply and discharge ducts 22, 23 are provided inside the small support shaft 12 and the arms 11.

With reference to FIGS. 3 to 9, during the rotational step which brings a cell 101 into the transfer station 3, the grippers 20 must initially be open in order to permit insertion of the front edge of the sheet F in the clamping mouth 21. Subsequently the gripper 20 is closed, and draws the sheet F together with the associated cell 101 to the transfer station T (FIGS. 3, 4, 6, 7, 9). When the group of cigarettes S is transferred from the cell 101 of the transfer drum 1 to the cell 102 of the folding drum 2, for example by thrust means 24, the gripper 20 must be opened once more in order to release the sheet F.

Figure 2:
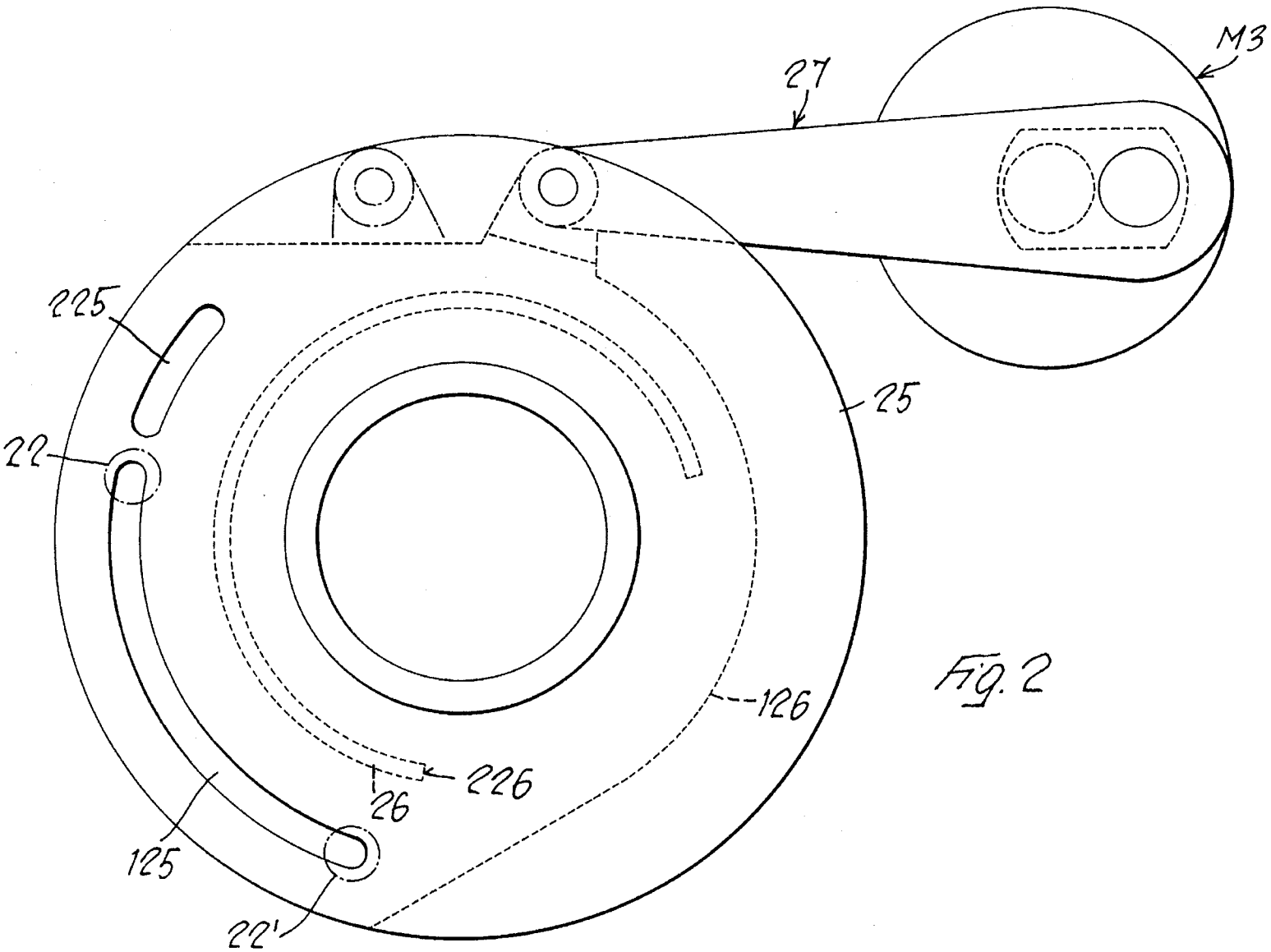
FIG. 2 is the front end view of a disc for distributing the pressurized fluid for driving the sheet grasping gripper.

In the embodiment illustrated, opening and closing of the gripper 20 is controlled by means of a controlling and distributing disc 25 (FIGS. 1A, 2). The distributing disc 25 is supported such as to rotate around its own axis coaxially to the transfer drum 1. This distributing disc 25 has two, arcuate, concentric through slots, respectively for supply and discharge 125, 225, which are provided one after the other with reference to the direction of rotation of the transfer drum 1. The opening in the supply duct 22 which is provided in the small support shaft 12 of the pair of arms 11 with which the gripper 20 is associated, is at a radial distance from the axis of the transfer drum 1 which is substantially identical to the radius of the slots 125, 225, such that during rotation of the drum, the said opening continues to coincide with the corresponding slot 125, 225, for the angular amplitude necessary for execution of the operative stages of closing of the gripper 20 and retention in a closed condition, as far as the transfer station T. The supply slot 125 is associated with the compressed air supply duct not shown. The discharge slot 225 is connected to the exterior. The distributing disc 25 is mounted such as to rotate in a sealed manner relative to the cell-carrying frame 5 of the drum 1 on the end flange 126 of a tubular shaft 26 which surrounds externally and coaxially the rotational tubular drive shaft 7 of the said cell-carrying frame 5. The tubular shaft 26 has an opening 226 by means of which the discharge slot 225 of the distributing .disc 25 communicates with the exterior, via a duct which connects it to the inner chamber of the tubular shaft 26. The flange 126 has an opening 326 for passage of the compressed air which coincides with the supply slot 125 of the distributing disc 25. The tubular drive shaft 26 of the distributing disc 25 is controlled by a separate motor M3 by means of a crank drive generally indicated 27, such as to carry out only limited angular movement in both directions relative to the transfer drum 1.

Therefore, as shown in particular by FIG. 2, the arrangement of the slots 125, 225 relative to one another and to the cell-carrying frame 5 of the transfer drum 1, can be selected such that in the position of supply of the sheet F to the gripper 20, the supply duct 22' of the corresponding small support shaft 12 for the arms 11 coincides with the rear end of the supply slot 125, with reference to the direction of rotation of the drum 1. During the rotational step which takes the associated cell 101 into the transfer station T, the gripper 20 must remain closed. In the transfer station T, the supply duct 22 for the compressed air in the small shaft 12 on the other hand coincides with the front end, with reference to the direction of rotation of the drum 1. During this stage, the distributing disc 25 is kept Stationary. In order to open the gripper 20, it is rotated in the opposite direction to the direction of rotation of the drum 1 relative to the latter during the stoppage of the drum 1, such that the slot 225 is made to coincide with the supply duct for the compressed air of the small support shaft 12, which is in the position indicated 22' in FIG. 2. The compressed air is discharged and the gripper 20 is opened. The disc is then taken once more into the starting position in FIG. 2, for closing of the gripper 20 associated with the subsequent cell 101.

The angular amplitude and the angular arrangement of the slots 125, 225 naturally depends on design factors associated with the layout of the arms 11 and the corresponding small support shaft 12, as well as with the arrangement of the point of collection of the sheet F from the supply unit 4.

Figure 3:
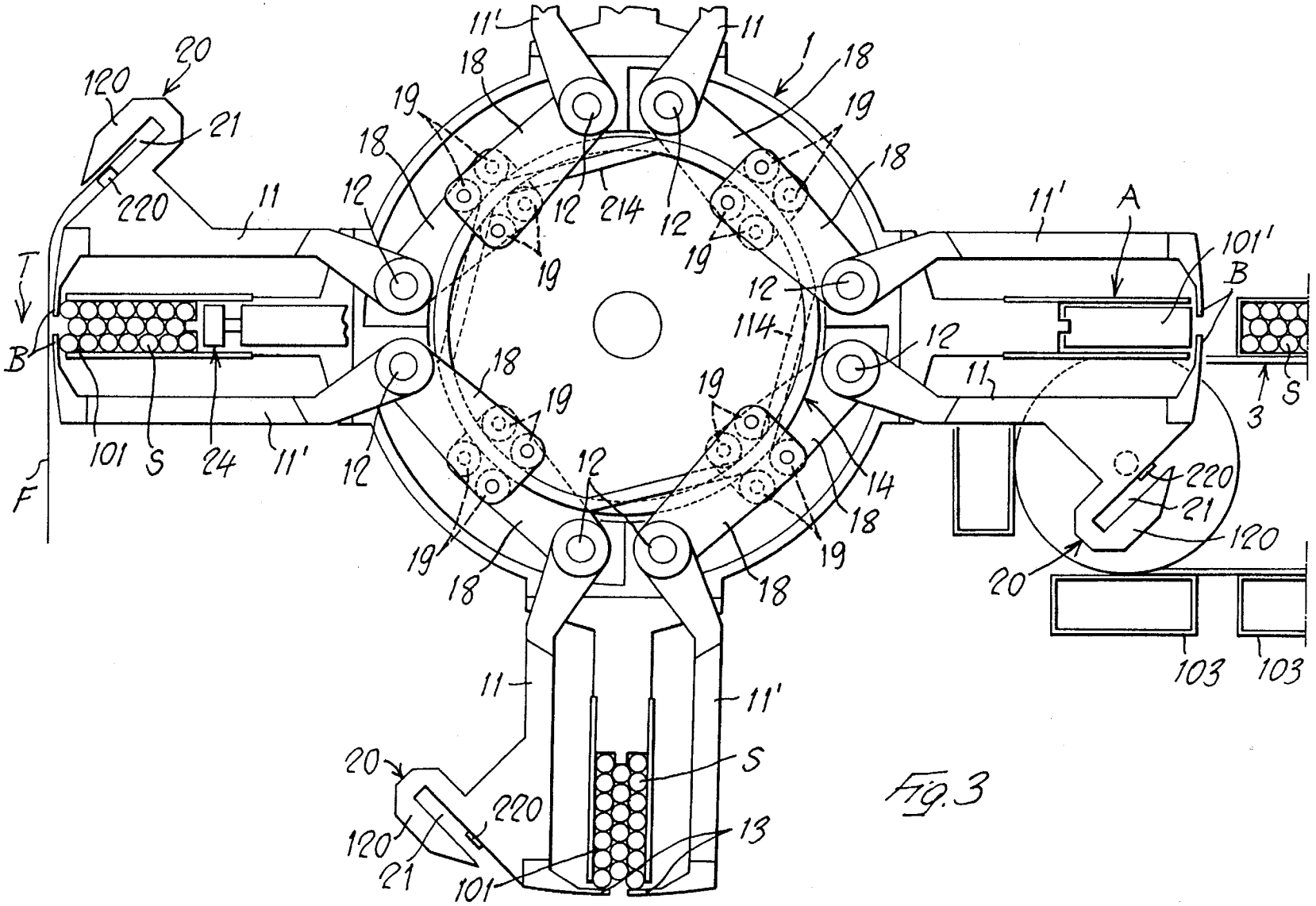
FIG. 3 is a view partially in cross-section of the transfer drum, in a stage immediately after a rotational step, and with the cell closing tabs all in the closed position.
Figure 4:
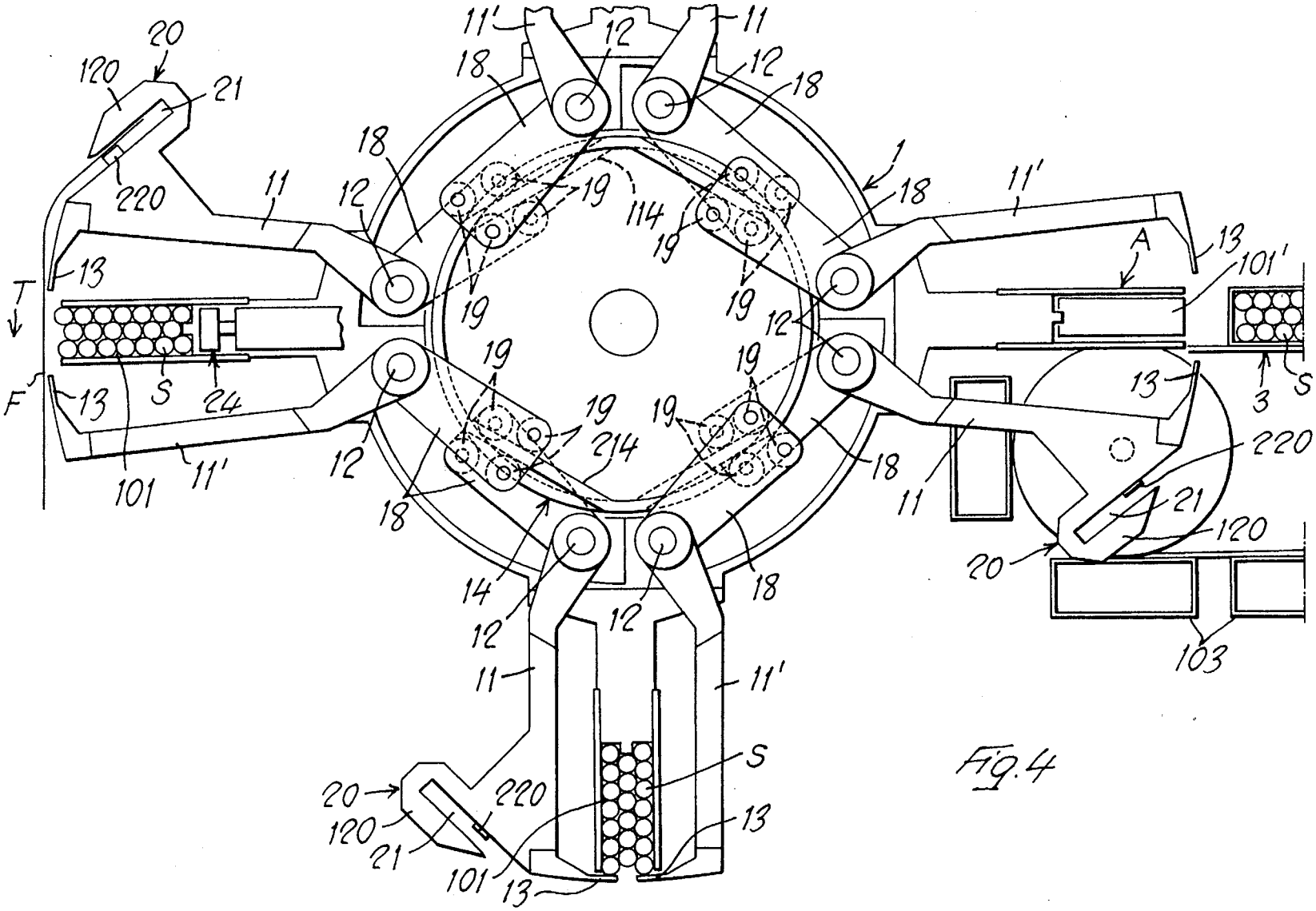
FIG. 4 is a view similar to FIG. 3, relating to the opening of the cell closing tabs, after a rotational step of the transfer drum.
Figure 5:
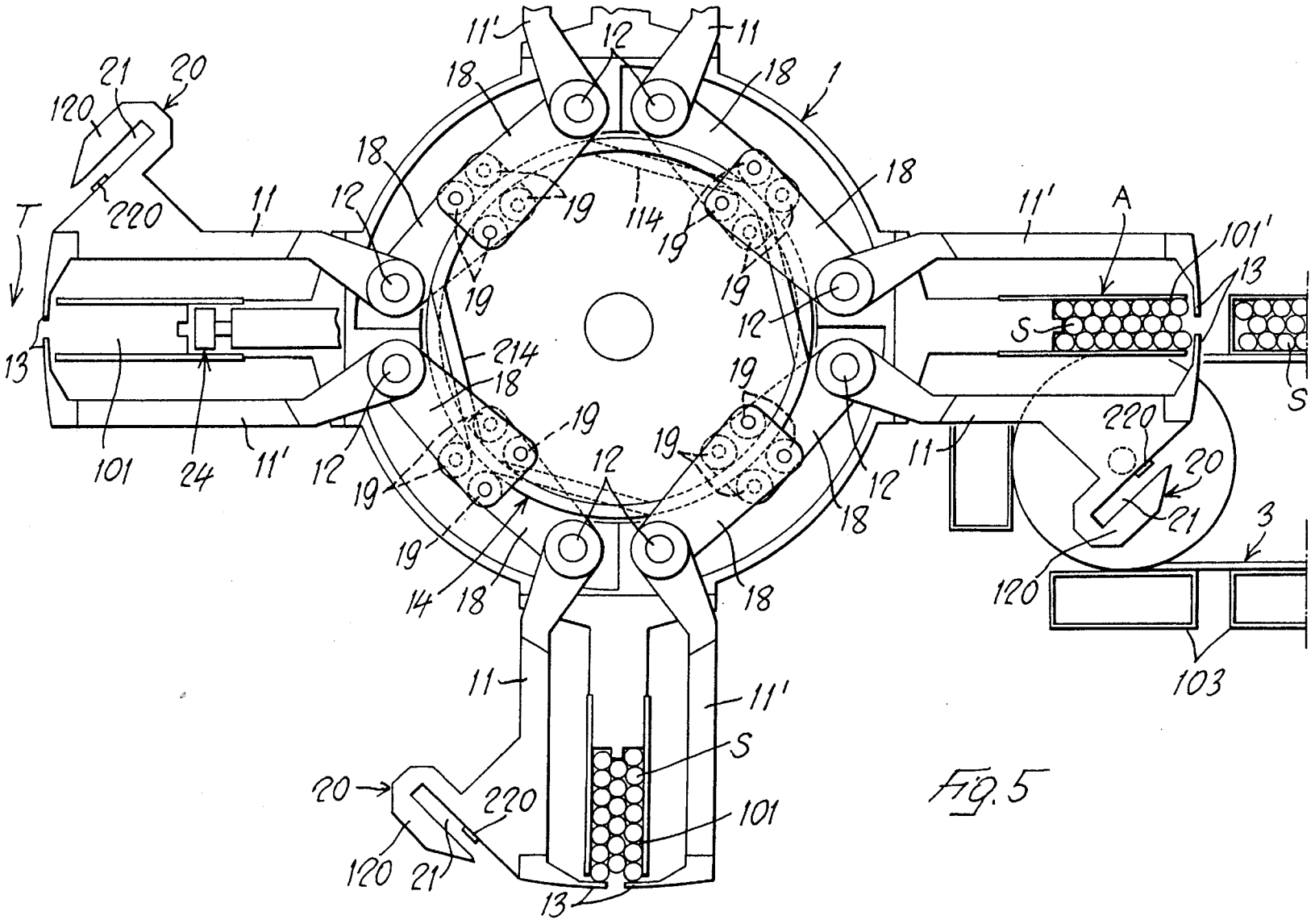
FIG. 5 is a view similar to FIGS. 3 and 4, relating to the closing of the cell closing tabs, immediately after transfer of the group of cigarettes and the sheet into a cell of a folding drum, and simultaneous filling of the cell diametrically opposite.
Figure 6:
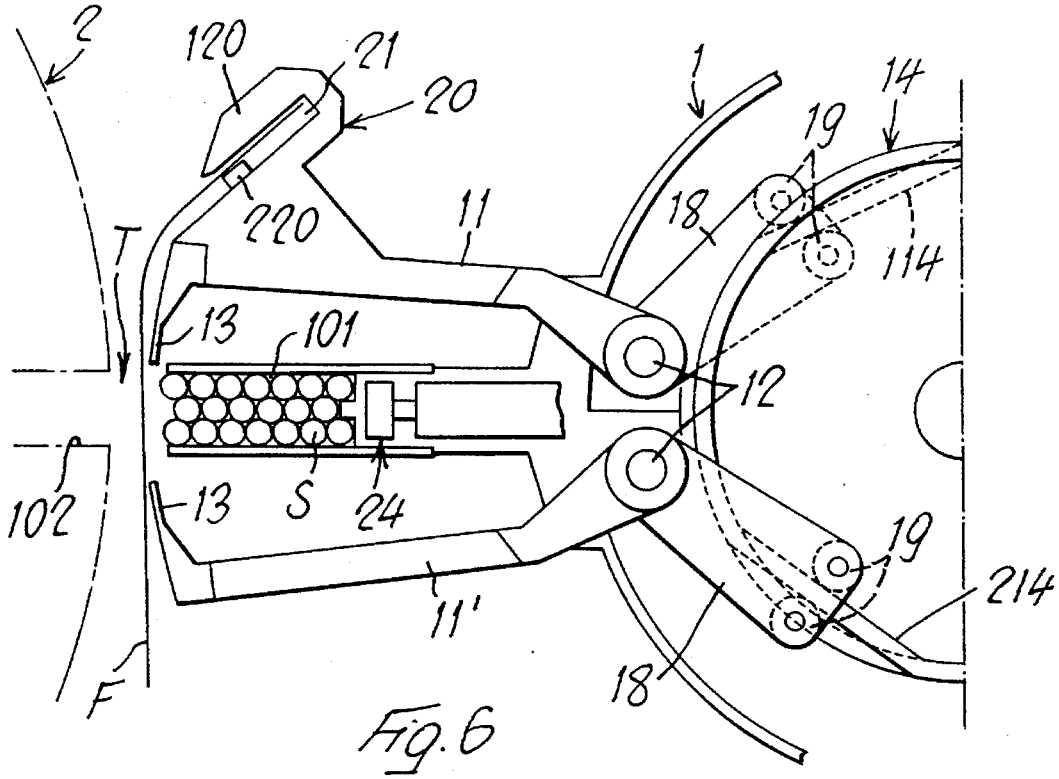
FIGS. 6 and 7 show details of the view according to FIG. 4, with the sheet grasping gripper in each of the two end positions for regulating the positioning relative to the associated cell.
Figure 7:
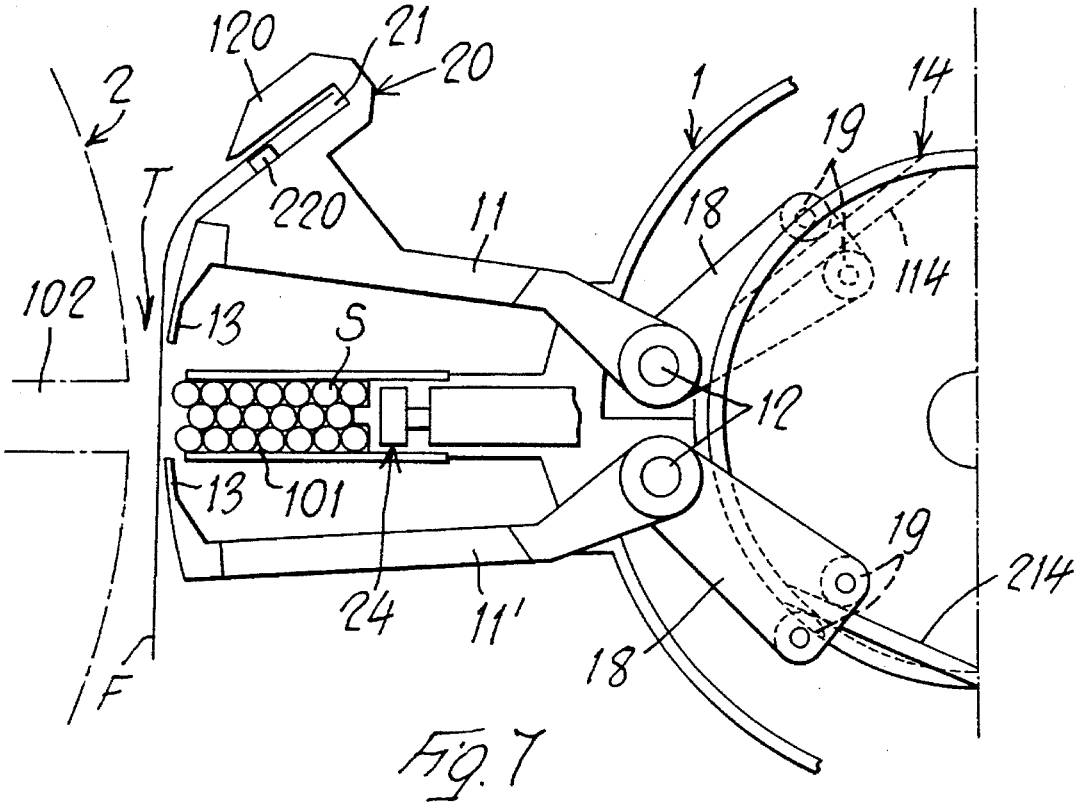

FIGS. 3 to 5 illustrate functioning of the device according to the above description. The transfer drum 1 has four cells 101 disposed crosswise from one another, and perform rotational steps of 90°. The cams 114, 214 are produced such that they enable the arms 11, 11', in other words all the cells 101, to be maintained closed during the rotational steps, in order to prevent the effects of centrifugal force on the cigarettes S. They also enable the arms 11, 11' of the cells 101, 101' in the transfer stations T and supply stations A to be opened up wider than the mouth of the cells, in order to permit firstly insertion of a group of cigarettes S, and secondly ejection of a group of cigarettes S, whilst maintaining in the closed position the arms 11, 11' which are associated with the cells 101 in the upper and lower vertical intermediate positions.

FIG. 3 shows the position of the cams 114 and 214 immediately after a rotational step of the transfer drum 1. The cells 101 are all closed and the Gripper 20 still retains the sheet F. Subsequently the cams 114 and 214 are rotated together relative to the drum 1 into the position in FIG. 4, in which only the arms 11, 11' are spread apart, which are associated with the cells 101, 101' only in the transfer station T and supply station. In this case, the closing tabs 13 can exert an effect of flattening or drawing the sheet F.

As shown in FIG. 5, after a new group of cigarettes S has been introduced into the cell 101' in the supply station A, and the group of cigarettes F has been ejected from the cell 101 in the transfer station T together with the sheet F, the cams 114, 214 are rotated once more relative to the drum 1 into a position of closing of all the cells 101.

Subsequently, the drum carries out a further rotational step, taking another full cell 101 and another empty cell 101' into the transfer station T and the supply station A. This condition is the same as that illustrated in FIG. 3.

Advantageously, the cams 114, 214 are produced such that they are always rotated in the same direction relative to the drum 1, identically to the rotational steps of the drum 1, such that they have two positions set apart symmetrically from one another by 180° in which the arms 11, 11' of all the cells 101 are in the position of closing the mouths of the cells.

Figure 8:
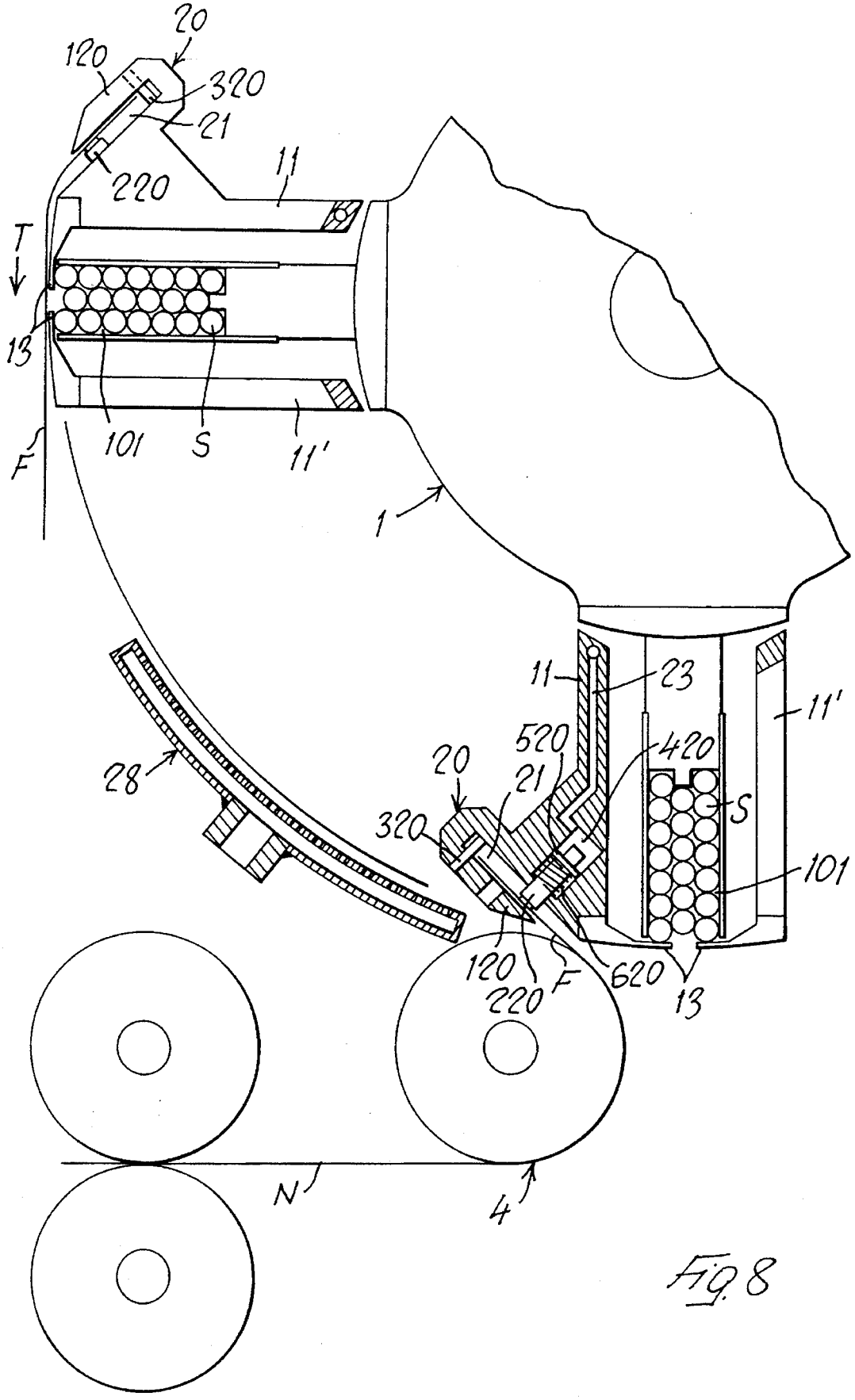
FIG. 8 is a first embodiment of the grasping gripper of the device according to the previous figures.
Figure 9:
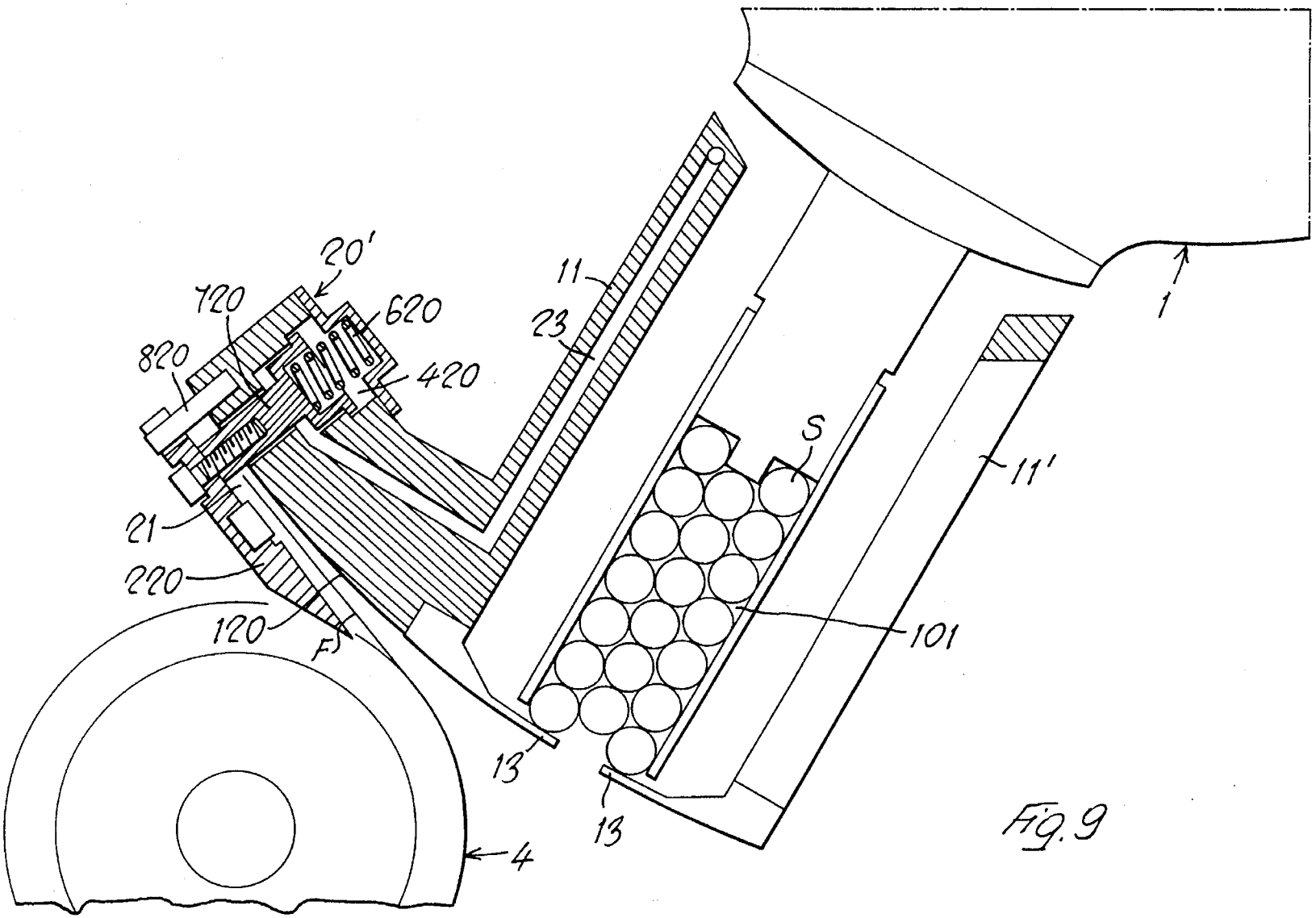
FIG. 9 is a second embodiment of the grasping gripper of the device according to the preceding figures.

On their front side with reference to the direction of rotation of the drum 1, the grippers 20 are provided with a stop element 320 for the sheet F, against which the front edge of the sheet F abuts (FIGS. 8 and 9). The stop 320 is in such a position that in the condition in which the arms 11, 11' associated with the cigarette-carrying cell 101 in the transfer station T are set apart (FIG. 4), the sheet F is positioned correctly relative to the said cigarette-carrying cell 101.

According to an improvement, a cam is provided to control oscillation of the arms 11, 11' which is shaped such that at least the front pair of arms 11, with reference to the direction of rotation of the drum 1, i.e. the pair of arms with which the gripper 20 is associated, can be moved for a specific angular distance relative to the associated cigarette-carrying cell 101 in the transfer station T, while the drum 1 is stationary. This allows fine adjustment to be carried out, or correction of the positioning of the sheet F relative to the cigarette-carrying cell 101. In particular, as shown in the figures 6 and 7, the cams 114 and 214 according to FIGS. 3 and 5 enable substantially parallel movement of the two pairs of arms 11, 11' to be carried out relative to the cell 101, both in the direction of rotation of the drum 1, and in the opposite direction. Oscillation of the arms 11, 11' for regulating the position of the sheet F is limited angularly, such that the closing tabs 13 are not superimposed at the mouth of the cigarette-carrying cell 101. With the cams 114 and 214 in the position in FIG. 4, the arms 11, 11' and thus the gripper 20 can be moved in the opposite direction to that of rotation of the drum 1, i.e. downwards relative to the cell 101, by means of slight rotation of the cams 114, 214 in the direction of rotation of the drum 1. The grippers 20 are moved in the opposite direction to the direction of rotation of the drum 1, i.e. upwards, by means of slight rotation of the cams 114, 214 in the direction of rotation of the drum 1. The correct position of the sheet F can be checked by means of position sensors, for example of the optoelectronic type, such as light barriers or the like, which provide electrical signals of position or presence to an electrical control unit.

FIG. 8 shows a first embodiment of a gripper 20. The gripper 20 comprises a stationary body with a U-shaped clamping mouth 21 which is oriented relative to the arms 11 such that in the closed position of the associated cigarette-carrying cell 101 in the vertical lower station, the said clamping mouth 21, i.e. the cooperating opposite sides of the jaws 120, 220 are parallel to the tangential direction of detachment of a sheet F from the supply roller 104 of the supply unit 4. The branch 120 which delimits the U-shaped mouth on the radially outer side is stationary, whereas in the opposite branch, a small piston 220 is mounted such as to slide in a sealed manner in a cylindrical chamber 420 which is perpendicular to the stationary branch 120. The cylindrical chamber 420 communicates with the supply ducts for compressed air 23 in the arms 11. Between the side opposite the inner end of an intermediate annular projection 420 of the small piston 220 and a shoulder in the position of the associated head of the cylindrical chamber 520, there is interposed a helical spring 620 which compresses the small piston 220 in the axially withdrawn position in the said cylindrical chamber 420, in the absence of compressed air. In the closed end of the U-shaped clamping mouth 21 there is provided a stop 320 which delimits the depth of insertion of the sheet F in the clamping mouth 21, ensuring correct positioning of the sheet F. In this case, the sheet F is collected with the associated cigarette-carrying cell 101 in the lower intermediate station during the stage of stoppage of the transfer drum 1.

According to an improvement, since the sheet F is retained only by its front edge with reference to the direction of rotation of the transfer drum 1, between the said lower intermediate station and the subsequent transfer station T, at least one element for flattening and drawing the sheet F, indicated 28, can be provided. This flattening element 28 is arcuate substantially according to the path of the rear end of the gripper 20, and is disposed concentrically to the said path at a specific radial distance. The flattening and/or drawing element 28 can advantageously be aspirating, such that the free edge of the sheet F is retained with some force. During rotation of the transfer drum 1, the sheet F drawn by the gripper 20 is flattened and tightened such that it assumes a perfectly flat shape in the transfer station T.

FIG. 9 illustrates a variant 20' of the gripper for grasping the sheet F. In this example, the mobile clamping jaw 220' is the radially outer one. It is supported such as to slide against the inner radially stationary jaw 120 by means of a small piston 720 which is guided such as to slide in a sealed manner in a cylindrical cheer 420, and which similarly to the previous example is subjected to the action of a spring 620 in the direction of opening of the gripper 20', whereas it is thrust against the stationary jaw 120 by means of the compressed air. The mobile jaw 220' is further guided on a guide pin 820 which is oriented parallel to the piston 720 and is engaged in a hole in the mobile jaw 220'. The stop marking the end of the introduction of the sheet F in the clamping mouth 21 consists of the rod of the small piston 720. In this example, the inclination of the U-shaped clamping mouth 21 is such that the sheet F is collected during the rotational step of the drum, in an intermediate position between the lower intermediate station and the transfer station T. In this case also, the clamping mouth 21 is oriented with the branches of the U consisting of the opposite sides of the mobile jaw 220' and stationary jaw 120, parallel to the direction of detachment of the sheet F from the supply roller 104.

We claim:

1. Device with a packaging wheel for supplying sheets, in particular in cigarette machines, which device comprises:

a folding drum for folding packaging sheets, for example made of foil, around individual groups of cigarettes, which folding drum is provided on its periphery with a plurality of cigarette-carrying cells each having a front opening and a rear side;

a transfer drum for transferring groups of cigarettes from a supply line to the folding drum, which transfer drum is mounted for rotational movement and is provided with at least one cigarette-carrying cell having a rear side and a front opening which is conveyed to a transfer station by rotation of the transfer drum into a position such that the front opening of the cigarette-carrying cell is aligned with the front opening of an empty cigarette-carrying cell of the folding drum;

drive means for moving cigarettes from the cigarette-carrying cell of the transfer drum into the cigarette-carrying cell of the folding drum;

each cigarette-carrying cell of the transfer drum being associated with collecting/positioning means each for one sheet, said collecting/positioning means being mounted for angular movement together with the associated cigarette-carrying cell, and which means, at the transfer station, position a sheet in a predetermined position corresponding to a group of cigarettes to be transferred between the associated cigarette-carrying cell of the transfer drum and the cigarette-carrying cell of the folding drum such that when a group of cigarettes is transferred into the cigarette-carrying cell of the folding drum, the sheet is thrust by the cigarettes into the cigarette-carrying cell and is folded in a U-shape around the cigarettes, characterized in that the collecting/positioning means consist of mechanical gripper means provided at least on the front side of each cigarette-carrying cell for grasping the packaging sheet and mounted for angular movement through a limited arc relative to the cigarette-carrying cell, said gripper means consisting of grippers with a clamping mouth which is delimited by two opposing jaws, one of which opposing jaws is stationary and the other of which opposing jaws is mounted for movement to a position at least partially against the stationary jaw, the clamping mouth being oriented parallel to the direction of supply of the sheets to the transfer drum, and open on the rear side, substantially corresponding to, or projecting slightly outwards radially relative to the front opening of the cigarette-carrying cell, and said mouth being provided with a stop which indicates the end of the introduction of the front edge of a packing sheet with reference to the direction of rotation of the transfer drum;

said gripper means being provided with a supply of pressurized fluid which activates the mobile jaw against the action of an elastic element which biases the mobile jaw towards the open position, the discharge of pressurized fluid being controlled in accordance with the closing and opening of the grippers by means of a distributing and controlling element which is supported such as to rotate relative to the support structure of the grippers, and is provided with a supply chamber which is connected to the source of the pressurized fluid and extends along the path of the supply inlet of the grippers during their angular rotation together with the transfer drum between the point of collection of a packaging sheet and the transfer station; and a discharge duct provided on the extension of the path of the supply inlet of the grippers and is positioned to coincide with the supply inlet of the gripper in the transfer station when the gripper is opened by virtue of relative angular rotation of the distributing and controlling element by means of a separate drive means associated therewith.

2. Device according to claim 1, characterized in that the distributing and controlling element consists of a disc which is supported such as to rotate coaxially relative to the transfer drum, and which is provided with through slots which are disposed in succession one after another and concentrically relative to the path of the supply inlet of the grippers for a predetermined angular amplitude.

3. Device according to claim 2, characterized in that the sheet is supplied at a point upstream of the transfer station, with reference to rotation of the transfer drum, an element for drawing and/or flattening the sheet being provided between the said point and the transfer station, which element is arcuate corresponding to the circular path of the rear end of the grippers with reference to the direction of rotation of the transfer drum, and is provided with means for attraction and frictional adhesion of the free rear end of a packaging sheet.

4. Device according to claim 3, characterized in that the transfer drum has means for closing the mouth of the cigarette-carrying cells which are supported on the transfer drum such that they can be moved alternately between an open position and a closed position of the mouth, the grippers of each cigarette-carrying cell being supported directly by the means for closing.

5. Device according to claim 4, characterized in that the closing means consist of two pairs or arms which are associated with the front opening and the rear side of each cigarette-carrying cell respectively, and which on their free ends, in the position of the mouth of the cigarette-carrying cells, support transverse tabs which each close part of the mouth, and are mounted such as to oscillate around axes parallel to the axis of rotation of the transfer drum, between a position of reciprocal approach, in which they close the mouth, and a position of reciprocal withdrawal, or spreading apart, in which the cigarette-carrying cell is open, forming between themselves a passage for the transfer of the group of cigarettes, whereas the grippers are attached to, or integral with, the pair of arms associated with the front opening of the cigarette-carrying cell, with reference to the direction of the rotation of the transfer drum.

6. Device according to claim 5, characterized in that oscillation of the arms is controlled by means of two cams which are coaxial to one another and rotate integrally around an axis which coincides with the axis of rotation of the transfer drum and rotates relative to the transfer drum, separate drive means being provided for the cams.

7. Device according to claim 6, characterized in that the cams consist of peripheral edges on the two opposite sides of a disc with a T-shaped cross-section, whereas the front arm and the rear arms, with reference to the direction of rotation of the transfer drum, engage respectively with one of the two cams for all the cigarette-carrying cells.

8. Device according to claim 7, characterized in that the cams are produced such that during the rotational steps of the transfer drum, the arms of all the cigarette-carrying cells are in the closed position of the latter, whereas in the stage of stoppage for supply of a group of cigarettes to the transfer drum, and transfer of a group of cigarettes to the folding drum, only the cigarette-carrying cells in the corresponding transfer stations and supply stations are open, the pair of front arms with reference to the direction of rotation of the transfer drum being moveable, at least in the transfer station, relative to the associated cigarette-carrying cell with slight rotation of the corresponding cam, without giving rise to closing of the mouth of this cigarette-carrying cell.

9. Device according to claim 8, characterized in that the cams are produced such that in their position in which the pairs of arms associated with the cigarette-carrying cell in the transfer station are spread apart, the cams give rise to movement of the said pairs of arms substantially in the same direction, with slight rotation thereof, giving rise to simultaneous translation of the two pairs in the same direction and for a substantially identical angular amplitude relative to the cigarette-carrying cell, in either direction, according to the direction of angular movement of the cams.

* * * * *